US007181881B2

(12) United States Patent
Fischbach et al.

(10) Patent No.: US 7,181,881 B2
(45) Date of Patent: Feb. 27, 2007

(54) METHODS AND APPARATUS TO LOCK A DUST COVER IN A FIREARM HOUSING

(75) Inventors: Wilhelm Fischbach, Deisslingen-Laufen (DE); Robert Knöpfle, Alpirsbach-Peterzell (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 10/728,403

(22) Filed: Dec. 5, 2003

(65) Prior Publication Data

US 2005/0016051 A1 Jan. 27, 2005

Related U.S. Application Data

(63) Continuation of application No. PCT/EP03/00674, filed on Jan. 23, 2003.

(30) Foreign Application Priority Data

Feb. 13, 2002 (DE) ..... 202 02 164

(51) Int. Cl.
*F41C 23/20* (2006.01)

(52) U.S. Cl. ..... 42/99; 42/71.01; 89/30; 49/478.1

(58) Field of Classification Search ..... 42/71.01, 42/96, 99, 70.01; 89/30; 70/267; 49/478.1
See application file for complete search history.

(56) References Cited

U.S. PATENT DOCUMENTS 2,659,114 A * 11/1953 Anderson et al. ..... 49/504
RE23,920 E * 1/1955 Mark et al. ..... 49/395
3,593,451 A 7/1971 McDonell
3,626,624 A * 12/1971 Greene
3,807,537 A * 4/1974 O'Reilly ..... 190/121
4,326,383 A * 4/1982 Reed et al. ..... 62/3.62
4,448,464 A * 5/1984 Reichert et al. ..... 312/408
4,480,407 A * 11/1984 Needham et al. ..... 49/168
4,579,034 A * 4/1986 Holloway
4,753,495 A * 6/1988 Swink
5,135,012 A * 8/1992 Kamen et al. ..... 132/294
5,950,450 A * 9/1999 Meyer et al. ..... 62/457.9

(Continued)

FOREIGN PATENT DOCUMENTS

DE 19903326 6/2000

OTHER PUBLICATIONS

United States Marine Corps Student Handout, *Service Rifle B2105*, "Part I: Fundamentals of Small Arms and Weapons Handling" [online], pp. 1-14. Retrieved from http://www.leatherneck.marines.usna.edu/images/Pubs/b2105.pdf (no date).

Navy Nonresident Training Course Manual, Chapter 3, "Service Rifle and Pistol Marksmanship" [online], pp. 1-22. Retrieved from http://www.globalsecurity.org/military/library/policy/navy/nrtc/14234_ch3a.pdf (no date).

(Continued)

*Primary Examiner*—Stephen M. Johnson
(74) *Attorney, Agent, or Firm*—Hanley, Flight & Zimmerman, LLC

(57) ABSTRACT

Methods and apparatus to lock a dust cover in a firearm housing are disclosed. An example firearm disclosed herein comprises a housing constructed substantially from non-magnetic material and defining an opening; a dust cover to cover the opening in the housing, the dust cover being pivotable between an open position and a closed position; and a magnetic lock to secure the dust cover in the closed position.

22 Claims, 3 Drawing Sheets

U.S. PATENT DOCUMENTS

| | | | |
|---|---|---|---|
| 6,036,292 | A * | 3/2000 | Mandel et al. |
| 6,314,672 | B2 | 11/2001 | Murello et al. |
| 6,523,293 | B2 | 2/2003 | Murello et al. |
| 6,719,132 | B2 * | 4/2004 | Sanders |
| 2001/0013192 | A1 | 8/2001 | Murello et al. |

OTHER PUBLICATIONS

International Search Report for PCT/EP03/00674, Jul. 22, 2003.

*Operator and Organizational Maintenance Manual including Basic Issue Items List and Repair Parts and Special Tools List Rifle, 5.56MM, M16 Rifle, 5.56MM, M16A 1 Bipod, Rifle, M3*,. Technical manual No. 9-1005-249-12, Department of the Army, Washington D.C., pp. 1-31 (Aug. 1968).

* cited by examiner

METHODS AND APPARATUS TO LOCK A DUST COVER IN A FIREARM HOUSING

RELATED APPLICATION

This patent issues from a continuation application which claims priority from International Patent Application Ser. No. PCT/EP03/00674 which was filed on Jan. 23, 2003, which is hereby incorporated by reference in its entirety.

FIELD OF THE DISCLOSURE

This disclosure relates generally to firearm housings, and, more particularly, to methods and apparatus to lock a dust cover in a firearm housing.

BACKGROUND

In the following disclosure, positional terms such as "above" and "below" are used with reference to a gun in its normal firing position, that is, positioned to shoot "forward" (away from the shooter) in a generally horizontal plane.

Dust covers for hand-held firearms have long been known in the art, especially from their use with handguns that have a housing. Example uses include covering the magazine opening, (e.g., the submachine gun MAS Mod. 1938) or the ejection opening (e.g., the assault rifle 44) of the firearm. In the case of a magazine dust cover, the dust cover employs a mechanical locking device such as a simple catch piece that may be opened and closed by hand. In the case of an ejection opening dust cover, the action of a spring causes the dust cover to open automatically when the moving breechblock opens the mechanical locking device. When not firing or when handling the gun, the ejection door may be closed by hand.

In traditional guns, the housing is made of steel or sheet metal that is sufficiently rigid to ensure a faultless operation of the locking device, even if the housing is constantly stressed by the spring when the dust cover is in the closed position.

Modern guns, however, often employ a plastic housing in which an expanded metal insert is added proximate to the locking device so that the locking device will seat properly. With improvements in design and construction, plastic housings have become more and more lightweight and, accordingly, more and more flexible. As a result, a housing of this type becomes temporarily deformed in a noticeable manner if, for example, the gun falls on the ground or strikes a solid obstacle with sufficient force. This deformation can cause the locking device to disengage in an undesired manner, so that the aforementioned cover opens just when the danger of foreign object entry is especially great. For example, dirt may enter the uncovered opening if the gun were to impact with a hard surface, such as a floor.

In housings with two ejection openings (for right-handed or left-handed marksmen), the opening that is not in use should remain closed in order to prevent possible damage that could otherwise result from, for example, sand or dust entering the gun. Moreover, as a general rule during operation, the marksman checks the used ejection opening only, and does not check the unused one.

To improve operation, expanded reinforcements could be embedded around the ejection opening and into the dust covers. However, these measures would be counter-productive because they would cause an increase in the weight of the housing. Another option would be to redesign the locking device so that it supports larger tolerances. This would mean, however, an increase in the cost of the firearm. Also, the required space is often not available.

DETAILED DESCRIPTION

Figure 1:
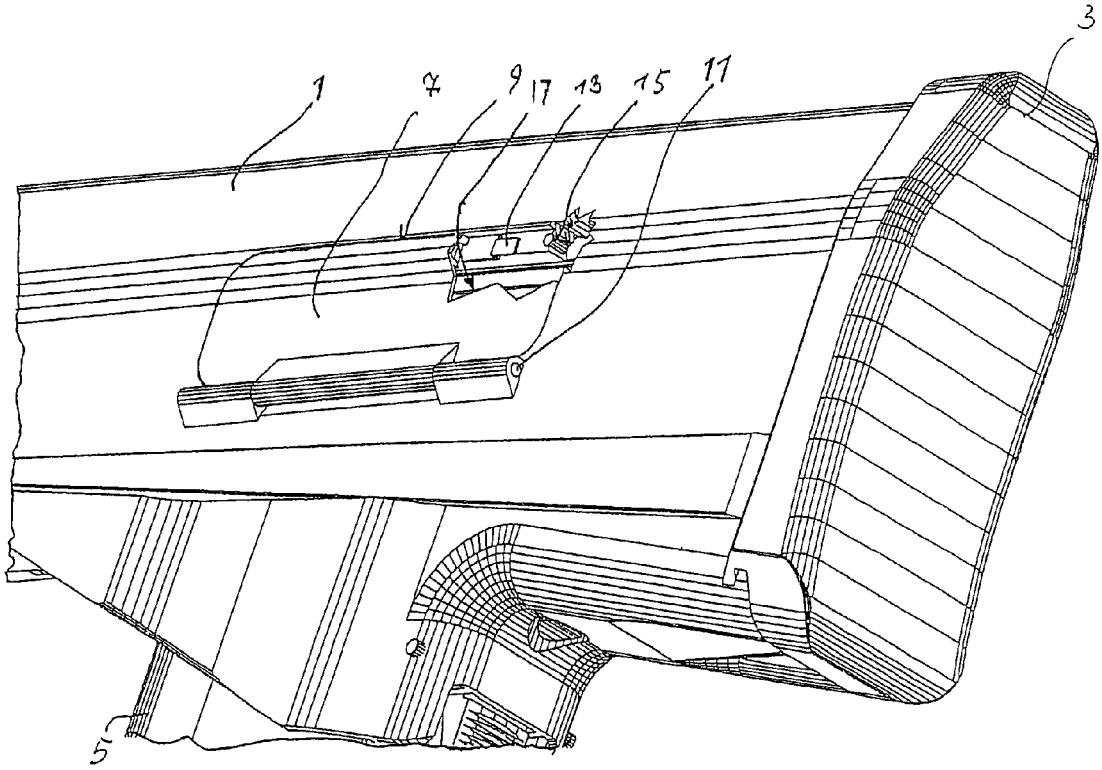
FIG. 1 is a schematic illustration of the truncated, rear part of an example semi-automatic rifle that is constructed in the so-called Bullpup configuration.

FIG. 1 is a schematic illustration of the truncated, rear part of an example semi-automatic rifle that is constructed in the so-called Bullpup configuration. In this example, the rifle has a housing 1 that surrounds the breechblock and its motion path (not shown in the figure). The housing 1 ends directly behind the aforementioned motion path. A floor plate 3 sits on the rear side of the housing 1 and, thus, directly borders the rear end of the motion path of the breechblock. Thus, to a certain extent, the rear stock that is traditional in sporting rifles has been left out of the figure. A magazine 5 is arranged on the underside of the housing 1 near the floor plate 3. The handle piece (not shown in the figure) is located in front of the magazine 5.

Figure 2:
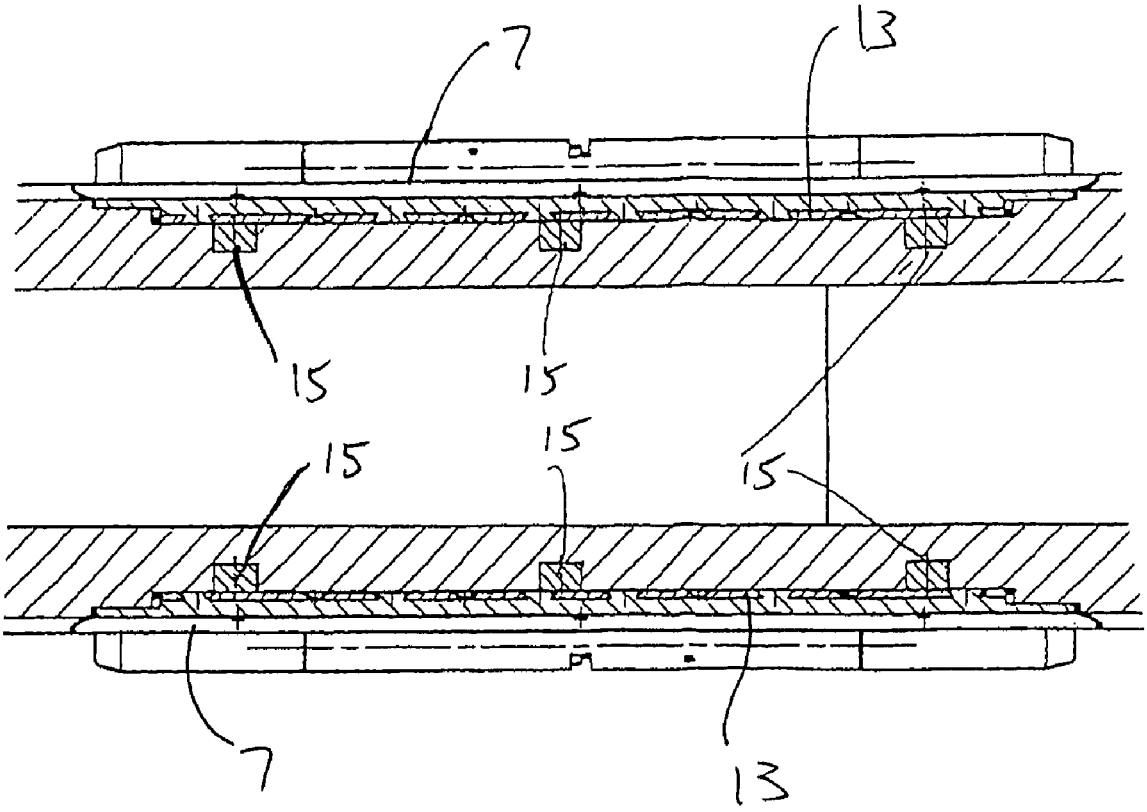
FIG. 2 is a schematic cross-sectional view through the weapon of FIG. 1 in the vicinity of the ejection openings.

A first dust cover 7 is visible above the magazine 5. This dust cover 7 is activated for left-handed marksmen. A second dust cover for right-handed marksmen is arranged on the opposite side of the housing 1 and is a mirror image of the first dust cover 7 (see FIG. 2).

The dust cover 7 covers an ejection opening 17. This opening is partially visible in the figure because the dust cover 7 is shown in a partially cutaway view. The dust cover 7 is generally rectangular. An axle 11 extends beneath and parallel to the underside edge of the opening 17. The underside of the dust cover 7 is pivotably mounted to the axle 11. The free upper edge 9 of the dust cover 7 extends approximately parallel to the underside edge of the cover 7.

In the illustrated example, a continuous, multiply crimped, and highly ferromagnetic steel sheet metal strip 13 is inserted into the side of the dust cover 7 that faces the housing. The strip 13 is oriented parallel to the upper edge 9 of the dust cover 7. Because of its crimping, the strip either emerges from the dust cover 7 or lies close to the surface of the dust cover 7 at a minimum of three points. One of these points is located approximately in the middle of the upper edge 9. Another of these points is near the front edge of the dust cover 7. The last point is near the rear edge of the dust cover 7. In the illustrated example, the strip 13 is manufactured together with the dust cover 7 in a composite casting. The free parts of the strip 13 are treated on the surface (e.g., bonded, phosphatized, or the like) in order to prevent rusting.

Proximate to each point of the strip 13 that emerges or lies close to the surface of the dust cover, a magnetic pin 15 is inserted into the wall of the housing 1 above the ejection opening 17. The magnetic pins 15 may be flush with a facing surface of the housing 1, or may even project slightly above the embedded plastic of the housing 1. Magnetic pins 15 and strip 13 are constructed and arranged so that they lie flat against each other when the dust cover 7 is closed.

An inner contour of the opening 17 is constructed to complement the outer contour of the dust cover 7 (taking into account tolerances). Opposite this inner contour, however, the actual opening is made as a shoulder in the housing wall at least in the area of the magnet pins 15, so that the closed dust cover 7 sits on this shoulder, but, in addition, borders flush with the outer surface of the housing 1 (except for the area of the axle 11). Thus, interfering edges, which could lead to untimely detachment of the magnetic lock, are avoided. An application of force from the outside, which could cause an untimely opening of the dust cover 7, is also prevented.

From the preceding description, one possessing ordinary skill in the art will appreciate the advantages of the illustrated example devices. For example, a magnetic lock employing a metal strip 13 and magnetic pins 15 as the locking mechanism is simple, cost-effective, and achieves reliable locking of the dust cover or covers 7 on a hand-held firearm or handgun, even if the housing 1 becomes deformed as a result of an applied force, e.g., as a result of dropping the weapon.

Magnetic locks have long been known for use in furniture and appliances, such as refrigerators. However, these magnetic locks are considered to be low-quality, whereas high-quality furniture typically employs mechanical locks. The magnetic locks in refrigerators function primarily for the purpose of ensuring that children who become trapped in the refrigerator can free themselves by simply pushing on the door, which would often not be possible if a mechanical lock had been engaged. As a result of this history, the stigma of a lesser locking function is still associated with the magnetic lock.

However, a magnetic lock is far superior to a mechanical lock under certain conditions in a handgun, such as, if the parts held together do not consist entirely of ferromagnetic material. Specifically, if the breechblock of the gun consists mostly of ferromagnetic material and is moved closely past the disclosed magnetic lock, the magnetic holding force of the lock will not significantly impede the breechblock movement because the lock is embedded on all sides in plastic. Furthermore, a magnetic lock can be constructed in such a way that it acts over a long distance, thus preventing a possibly existent magnetic field of the breechblock from simultaneously affecting the entire magnetic lock. If the illustrated magnetic lock is accidentally disengaged (e.g., if the housing 1 is temporarily deformed), it will also shut itself again. For example, if an edge 9 of the dust cover 7 moves outwardly due to a deformation of the housing 1, the edge 9 is pulled shut again after the deformation is removed. Thus, the projecting edge 9 will not cause the lock to disengage.

Figure 3:
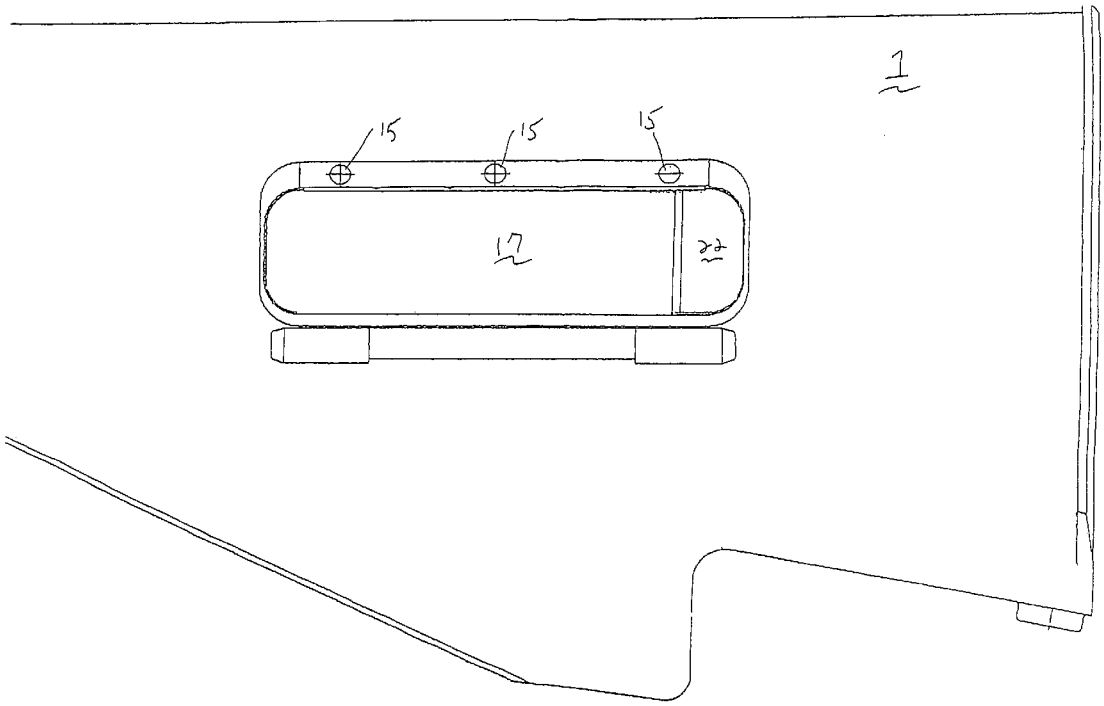
FIG. 3 is a schematic view of an alternative example weapon illustrating two openings which may be covered by the same dust cover.

The dust cover 7 can cover more than one opening. For example, the dust cover 7 may cover the magazine opening and/or another opening 22 (such as one provided for the storage of a cleaning tool or the like) in the gun (see FIG. 3). Preferably, however, the dust cover 7 is located to cover an ejection opening 17 for cartridge shells, and the recoil movement of the breechblock opens the magnetic lock securing the dust cover 7.

It would be possible to construct the dust cover 7 out of sheet metal and to embed one or more magnets into the opposing housing 1. However, it is disadvantageous to manufacture a sheet metal cover of this type because it is more costly than a plastic cover, as the latter does not require any finishing work. Moreover, a sheet metal cover is considerably heavier than a plastic cover. Therefore, the illustrated example magnetic lock has at least one strip 13 made of ferromagnetic material inserted into the dust cover 7 near its free edge 9. Opposite the strip 13, at least one magnetic pin 15 is inserted into the housing 1 of the gun, whereby the longitudinal axis of the pin 15 extends perpendicularly or approximately perpendicularly to the strip 13.

The strip 13 is made of ferromagnetic material—usually steel sheet metal—and, thus, reinforces the dust cover 7 (which is made of plastic) to a significant extent. Thus, a lightweight construction is achieved, which, moreover, is quite rigid in the areas that are subject to the magnetic effect. The stability of the dust cover 7 is, therefore, ensured, which results in good action of the magnetic lock.

If the ferromagnetic strip 13 is viewed as a plane, then the axis of the pin-shaped magnets and/or magnetic pins 15 extends in a generally perpendicular manner relative to the strip 13. A magnetic pin 15 is quite lightweight and acts as a local reinforcement of the housing 1. Also, it is possible to manufacture extremely powerful magnets in the form of relatively small pins using sintering technology. Thus, the magnetic pins 15 may be injected, adhered or welded into the housing 1. The embedding of the magnetic pin 15 by at least its width into the plastic housing 1 protects its sintered compact from breaking into pieces due to forceful impacts or the like. Even if broken, the embedded pieces will remain at the desired site and position in the housing 1 and, thus, retain their magnetic effect.

In experiments it has proven advantageous to allocate at least three magnetic pins 15 to the dust cover or each dust cover 7. A strip 13 made of ferromagnetic material is inserted into the dust cover 7 opposite each magnetic pin 15.

To illustrate an example firearm, consider a rather large caliber cartridge, such as a long shotgun cartridge of the caliber 12, which corresponds to an example dust cover 7 that can be approximately 90 mm long and approximately 25 mm high. This dust cover 7 may be made (aside from the strip or strips 13 inserted into the dust cover) entirely out of plastic. The three magnetic pins 15 act as a reinforcement of the upper edge of the ejection opening 17. In the area of the ejection opening 17, the plastic housing 1 may be designed so that it is at times double-walled. In such a case, the magnetic pins 15 are preferably embedded solidly in both wall layers.

It can be advantageous to have adjacent magnetic pins 15 oriented so that alternating, opposite poles point to the outside of the housing 1, or that all magnetic pins 15 point to the outside with the same pole. The preferred arrangement depends on whether a single sheet metal strip 13 is inserted in the upper edge of the dust cover 9 which opens to the bottom, or whether a different steel sheet metal strip 13 is allocated to each magnet.

Although certain example methods and apparatus have been described herein, the scope of coverage of this patent is not limited thereto. On the contrary, this patent covers all methods and apparatus fairly falling within the scope of the appended claims either literally or under the doctrine of equivalents.

What is claimed is:

1. A firearm comprising:

a firearm housing constructed substantially from non-magnetic material and defining an opening;

a breechblock;

a dust cover to cover the opening in the housing, the dust cover being pivotable between an open position and a closed position, wherein the dust cover is pivoted from the closed position to the open position in response to a recoil movement of a breechblock; and a magnetic lock to secure the dust cover in the closed position.

2. A firearm as defined in claim 1 wherein the housing is constructed from plastic.

3. A firearm as defined in claim 1 wherein the magnetic lock comprises:

a magnetic strip mounted to at least one of the housing and the dustcover; and at least one magnetic pin mounted to the other one of the housing and the dust cover to attract the magnetic strip.

4. A firearm as defined in claim 3 wherein the magnetic strip is embedded in the dust cover.

5. A firearm as defined in claim 3 wherein the magnetic strip is embedded in the housing.

6. A firearm as defined in claim 3 wherein the magnetic strip is constructed from sheet metal.

7. A firearm as defined in claim 3 wherein the magnetic strip is crimped in at least one location along its length.

8. A firearm as defined in claim 3 wherein the magnetic strip is embedded in a side of the dust cover that faces the housing when the dust cover is in the closed position.

9. A firearm as defined in claim 3 wherein the magnetic strip is attached to a side of the dust cover that faces the housing when the dust cover is in the closed position.

10. A firearm as defined in claim 3 wherein the at least one magnetic pin has a longitudinal axis, and the at least one magnetic pin is embedded in the housing with the longitudinal axis substantially perpendicular to the magnetic strip when the dust cover is in the closed position.

11. A firearm as defined in claim 10 wherein an end of the at least one magnetic pin is generally flush with a side of the housing.

12. A firearm as defined in claim 3 wherein the at least one magnetic pin includes three magnetic pins distributed along an edge of the opening.

13. A firearm as defined in claim 12 wherein:

a first one of the magnetic pins is located near a first end of the edge of the opening;

a second one of the magnetic pins is located near a second end of the edge of the opening; and a third one of the magnetic pins is located between the first and second magnetic pins.

14. A firearm as defined in claim 3 wherein the ones of the magnetic pins are arranged such that magnetic fields for adjacent magnetic pins point in substantially opposite directions.

15. A firearm as defined in claim 3 wherein the magnetic pins are arranged such that magnetic fields for the magnetic pins point in substantially the same direction.

16. A firearm as defined in claim 3 wherein the at least one magnetic pin is at least one of injected into the housing, adhered to the housing, and welded to the housing.

17. A firearm as defined in claim 1 wherein the dust cover is biased toward the open position by a spring.

18. A firearm as defined in claim 1 wherein the opening is an ejection opening.

19. A firearm as defined in claim 1 further comprising:

a second opening defined in the housing;

a second dust cover to cover the second opening in the housing, the second dust cover being pivotable between an open position and a closed position; and a second magnetic lock to secure the second dust cover in the closed position.

20. A firearm as defined in claim 1 wherein the opening comprises a first opening, and further comprising a second opening, wherein the dust cover covers the first and the second opening when the dust cover is in the closed position.

21. A method of operating a firearm as defined in claim 1 comprising: moving the breechblock from a forward position to a rearward position;

pivoting the dust cover from the closed position to the open position in response to the movement of the breechblock;

pivoting the dust cover from the open position to the closed position; and securing the dust cover in the closed position with the magnetic lock.

22. A method for manufacturing a firearm as defined in claim 1 comprising:

covering the opening in the housing with the dust cover positioned to pivot open in response to a motion of the breechblock;

securing an edge of the dust cover to allow the dust cover to pivot between the open position and the closed position; and using at least one magnetic field to attract the dust cover to the housing such that the dust cover is locked in the closed position.

* * * * *